US008644748B2

(12) United States Patent
Clark et al.

(10) Patent No.: US 8,644,748 B2
(45) Date of Patent: Feb. 4, 2014

(54) SELF-STRIPPING BELT-ROLL FUSER APPARATUS AND SYSTEMS

(75) Inventors: Lawrence Arnold Clark, Webster, NY (US); Steven Matthew Russel, Bloomfield, NY (US); Stephen Bradley Williams, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 110 days.

(21) Appl. No.: 13/357,404

(22) Filed: Jan. 24, 2012

(65) Prior Publication Data

US 2013/0189006 A1 Jul. 25, 2013

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

2010/0310289 A1* 12/2010 Someya et al. ..... 399/329

* cited by examiner

*Primary Examiner* — Hoang Ngo
(74) *Attorney, Agent, or Firm* — Ronald E. Prass, Jr.; Prass LLP

(57) ABSTRACT

A belt-roll fuser system includes a belt-roll fuser apparatus wherein a belt is entrained about at least a first internal pressure roll and a second internal pressure roll. The first internal pressure roll and the second internal pressure roll are configured to force a belt against an external pressure roll at a fusing nip, the belt conforming to the external pressure roll across substantially a length of the fusing nip. A passive belt support may interpose internal pressure rolls for ensuring a consistent fusing pressure across the length of the nip. A pressure belt may interpose the fuser belt and the internal pressure rolls.

15 Claims, 6 Drawing Sheets

SELF-STRIPPING BELT-ROLL FUSER APPARATUS AND SYSTEMS

FIELD OF DISCLOSURE

The disclosure relates to apparatus and systems for belt-roll fuser stripping. In particular, the disclosure relates to belt-roll fuser stripping apparatus and systems having a self-stripping configuration at a fuser nip.

BACKGROUND

Related art belt-roll fusers include a hard internal pressure roll and a soft external pressure roll. The internal pressure roll, or fuser roll, and the external pressure roll, or pressure roll, together form a fusing nip for fusing marking material such as toner to a sheet, after the sheet has received toner from a transfer station. A fuser belt may be entrained by the internal roll and three outer heated rolls, the fuser belt extending through the nip.

During a printing process, a paper sheet that is fused at the nip may stick to the fusing belt after passing through the nip. Typically, a strip shoe is implemented to strip the sheet from the fusing belt. The strip may have, for example, a less than 5 mm stripping radius. The fusing belt wraps around the strip shoe causing a bend in the belt at which paper leaves the belt surface during processing. Related art fusing nips cause image quality defects such as "retacking", gloss defects such as "icicles".

SUMMARY

A fuser nip configuration in accordance with embodiments that implements a single continuous arc fusing zone profile is advantageous over the traditional three-zone nip profile. A sheet fused by a fusing nip in a belt-roll fuser apparatus in accordance with an embodiment is subject to a pressure sufficient to force the sheet into contact with the pressure roll for the entire period of time during which the sheet is in the fusing nip. While the sheet is traveling through the nip, the continuous contact accommodated by the single continuous arc fusing zone maintains continuous fuser belt-to-sheet contact through the fusing nip and allows controlled exit of the sheet from the nip, including preventing a change of a bend direction in the sheet that would otherwise cause image defects as the sheet to exits the nip. Apparatus and systems of embodiments include accommodate fusing of an image on a sheet under continuous nip pressure and controlling an exit of the sheet from the nip to allow the sheet to strip from the belt at a desired nip exit point without re-tacking or being subject to other image qualify defect-causing factors.

In an embodiment, a self-stripping belt-roll fuser apparatus may include a first internal pressure roll; a second internal pressure roll; a fuser belt, the fuser belt being supported by at least the first internal pressure roll and the second internal pressure roll, the first internal pressure roll and the second internal pressure roll being configured to engage an external pressure roll to define a fusing nip. The first internal pressure roll may be configured to define a nip entrance, and the second internal pressure roll may be configured to define a nip exit.

In an embodiment, a belt-roll fuser apparatus may include a third internal pressure roll, the third internal pressure roll being configured to engage the external pressure roll to define the fusing nip, the third internal pressure roll interposing the first internal pressure roll and the second internal pressure roll. The first internal pressure roll and the second internal pressure roll may have radii that are each smaller than a radius of the external pressure roll.

In an embodiment, a belt-roll fuser apparatus may include a passive belt support. The belt support may be configured to interpose the first internal pressure roll and the second internal pressure roll for preventing deflection of the belt away from the external pressure roll at the fusing nip when the first internal pressure roll and the second internal pressure roll are engaged. The passive belt support may be arranged so that the belt does not contact the support when the belt is not deflected.

In an embodiment, the second internal pressure roll may have a radius that is smaller than a radius of the first internal pressure roll. In an embodiment, the first internal pressure roll and the second internal pressure roll may have radii that are each less than a radius of the external pressure roll.

In an embodiment, when the belt roll apparatus is engaged with the external pressure roll to define the fusing nip, the first internal pressure roll may force the fuser belt against the external pressure roll at a nip entrance, and the second internal pressure may force the fuser belt against the external pressure roll at the nip exit. In an embodiment, the fuser belt may be conformed to the external pressure roll from the nip entrance to the nip exit, the belt being conformed to the external pressure by at least the first internal pressure roll and the second internal pressure roll.

In embodiment, a belt-roll fuser apparatus may include a pressure belt, the pressure belt being entrained by a pressure belt support roll, the first internal pressure roll, and the second internal pressure roll, the pressure belt interposing the fuser belt and the pressure belt support roll, first internal pressure roll, and second internal pressure roll. The pressure belt may be a hard belt. For example, the pressure belt may comprise a metal surface.

In an embodiment, the fuser belt may heated for fusing a sheet at the fusing nip. In an embodiment, the external pressure may be heated for fusing a sheet at the fusing nip.

In an embodiment of self-stripping belt roll fuser systems for printing systems, systems may include an external pressure roll; a first internal pressure roll; a second internal pressure roll; a fuser belt, the fuser belt being supported by at least the first internal pressure roll and the second internal pressure roll, the first internal pressure roll and the second internal pressure roll being configured to engage the external pressure roll to define a fusing nip. In an embodiment, a belt-roll fuser system may include a pressure belt, the pressure belt being entrained by at least the first internal pressure roll and the second internal pressure roll, the pressure belt interposing the fuser belt and the first internal pressure roll and the second internal pressure roll. The pressure belt may include a metal surface.

In an embodiment, the first internal pressure roll and the second internal pressure roll may each have a radius that is less than a radius of the external pressure roll. In an embodiment, a radius of the first internal pressure roll may be greater than a radius of the second internal pressure roll. In an embodiment, the fuser belt may include a surface that is softer than the pressure belt.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
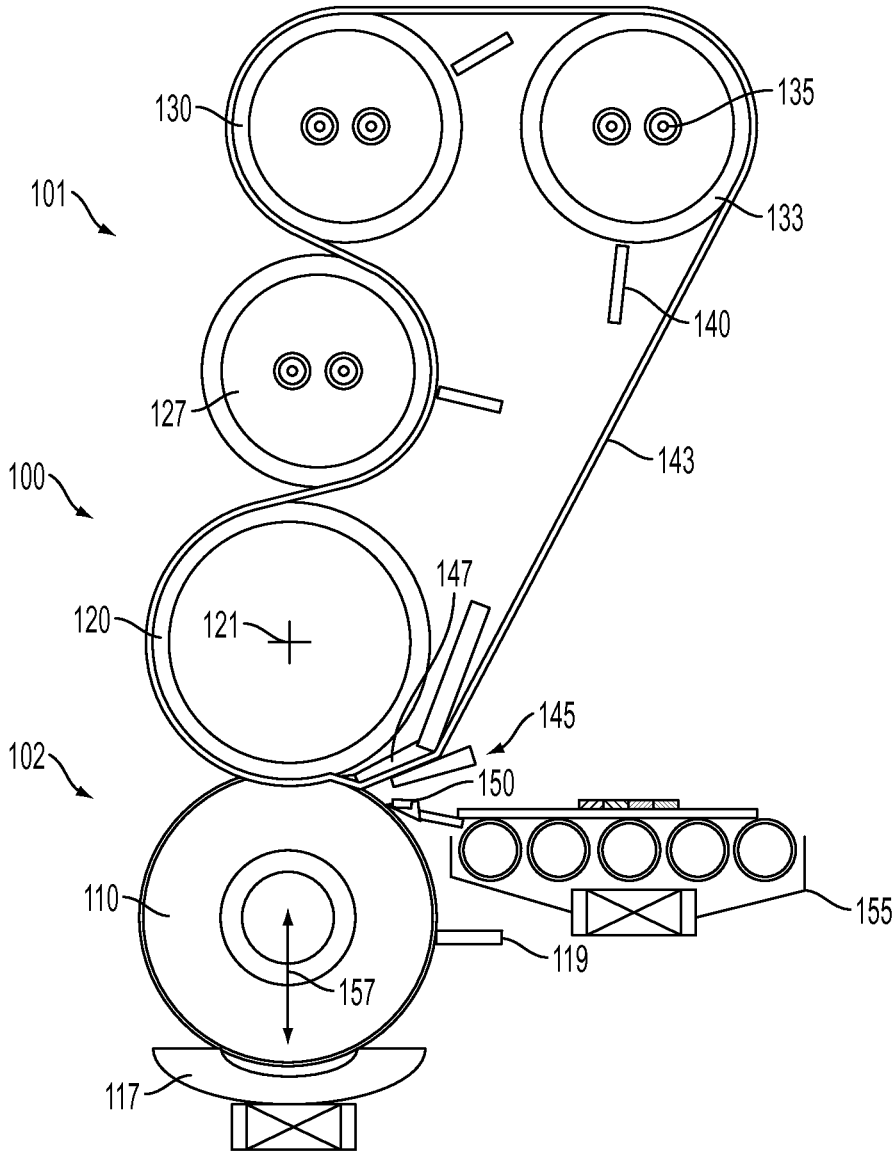
FIG. 1 shows a diagrammatical side view of a related art belt-roll fuser system having an internal pressure roll engaged with an external pressure roll of a belt-roll fuser implementing a related art nip profile and sheet-stripping configuration.

Exemplary embodiments are intended to cover all alternatives, modifications, and equivalents as may be included within the spirit and scope of the apparatus and systems as described herein.

Reference is made to the drawings to accommodate understanding of apparatus and systems for fusing an image to a sheet at a fusing nip that accommodates continuous belt-to-sheet contact through the nip, and a controlled exit and self-stripping of the sheet from the nip. In the drawings, like reference numerals are used throughout to designate similar or identical elements. The drawings depict various embodiments of illustrative self-stripping apparatus and systems.

Apparatus and systems of embodiments may include systems for printing images on substrates such as paper sheets. The printing process includes a fusing step wherein marking material such as toner is fused to the sheet using heat and pressure. Exemplary substrates may include media webs, such as a paper webs. Alternatively, the system may be configured to feed cut sheets to a fixing or fusing nip of the belt-roll fuser.

A related art belt-roll fuser system is shown in FIG. 1. Specifically, FIG. 1 shows a belt-roll fuser system 100. The belt-roll fuser system 100 may include a belt-roll fuser apparatus 101. The belt-roll fuser apparatus 101 may be configured to latch to and unlatch from a main frame portion 102 of the belt-roll fuser system 100. The belt-roll fuser main frame 102 may include an external pressure member 110, and the belt-roll fuser module 101 may include an internal pressure member 120. When the belt-roll fuser module is in a latched position, i.e., when the belt-roll fuser apparatus 101 is latched to the main frame 102, the internal pressure member 120 may be engaged with the external pressure member 110 to define a fusing nip. When the belt-roll fuser apparatus 101 is unlatched from the main frame 102, the belt-roll fuser apparatus 101 may be separated from the main frame 102 whereby access may be accommodated for, e.g., servicing or replacing components of the belt-roll fuser system 100.

The external pressure member 110 may be removable. Accordingly, when the belt-fuser apparatus 101 is separated from the belt-roll fuser main frame 102, the external pressure member 110 may be accessed for cleaning and/or servicing. For example, the external pressure member 110 may be customer replaceable.

The external pressure member 110 may be associated with a pressure roll cooling system. For example, FIG. 1 shows a pressure roll cooling system 117 positioned below an external pressure member 110. A pressure member monitoring device 119 may be included and configured for monitoring the pressure member 110. For example, monitoring device 119 may be a thermistor, such as a contact thermistor.

As shown in FIG. 1, the internal pressure member 120 may be engaged with the external pressure member 110 to form a fusing nip. The fusing nip may be formed when the belt-roll apparatus 101 is latched to the main frame 102 of the belt-roll fuser system 100.

The belt-roll fuser apparatus 101 may include a plurality of belt members. The belt members may be rolls, as shown, that rotatable about an axis, e.g., a longitudinal access, to facilitate movement of a fuser belt. The belt members may be rolls that support, clean, and/or steer the belt as it translates about the plurality of members and an internal pressure member. For example, FIG. 1 shows a belt-roll apparatus 101 including an internal pressure member 120, wherein the belt-roll apparatus 101 is positioned to engage the internal pressure member 120 with the external pressure member 110 of the belt-roll main frame 102. The internal pressure member 120 shown in FIG. 1 is a cylindrical member that is rotatable about longitudinal axis, e.g., a central longitudinal axis 121.

The belt-roll module 101 may include a cleaner member 127 positioned so that the internal pressure member 120 interposes the cleaner member 127 and the external pressure member 110 when the belt-roll module 101 is positioned to engage the internal pressure member 120 with the external pressure member 110 of the main frame of the belt-fuser system 100. The cleaner member 127 may be a rotatable member that facilitates support and translation of a belt. For example, the cleaner member 127 may be a roll, such as a cylindrical roll that is rotatable about its central longitudinal axis. The cleaner roll 127 may be associated with, for example, a web cleaning system or a belt cleaning system. A web cleaning system may include a plurality of members that facilitate cleaning of a web or belt of the belt-roll fuser system. The web cleaning system may be customer replaceable, facilitated by, e.g., the latching and unlatching operability of the belt-roll fuser module 101. The internal pressure member 120 may be associated with a metering system. A metering system may include one or more metering members, such as a media roll.

The belt-roll fuser apparatus 101 of FIG. 1 may include a belt member 130. The belt member 130 may be rotatable. For example, the belt member 130 may be a roll, such as a cylindrical roll that is rotatable about its central longitudinal axis. The belt-roll module 130 may include a tension member 133. The tension member 133 may be a roll, such as a cylindrical roll that is rotatable about its central longitudinal axis. The tension member 133 may be associated with a belt tensioner. The tension member 133 may be configured to accommodate belt tracking and steering. Each of the cleaner member 127, the belt member 130, and the tension member 133 may be heated. For example, the tension member 133 may include a heating element 135. One or more of the members of the belt-roll module 101 may be monitored by various monitoring devices 140. For example, the monitoring devices may be thermistors such as contact thermistors.

Each of the internal pressure member 120, the cleaner member 127, the belt member 130, and the tension member 133 may be configured to entrain a belt 143. The belt 143 may translate about the rotatable members, and may absorb heat from heated entraining rotatable members or rolls. The belt 143 may be replaceable. For example, the belt-fuser apparatus 101 may be positioned to accommodate access to components of the belt-roll fuser module 102 thereby enabling, e.g., user replacement of the belt 143. Belt thermistors (not shown) may be arranged about the belt 143.

The belt 143 may pass through a nip defined by the internal pressure member 120 of the belt-roll apparatus 101 and the external pressure member 110 when, e.g., the belt-roll apparatus 101 is latched to the main frame 102. Post-fusing processing components may be situated about the nip; specifically, about an exit of the nip. For example, an air knife 145 may be at the exit nip. Also, a stripping shoe 147 may be configured to interpose the internal pressure roll 120 and the belt 143 for bending the belt at a stripping angle to form a corner of the belt 143 at the nip exit at which the sheet may be stripped from the belt. The belt 143 may be wrapped around a corner of the stripping shoe 147, at which point paper may caused to leave a surface of the belt that extends in a process direction beyond the corner of the stripping shoe 147.

An exit sensor 150 may positioned at an exit of the fusing nip. A substrate having a fused image may be carried by a post-fuser transport system 155 after the substrate exits the fusing nip.

Figure 2A:
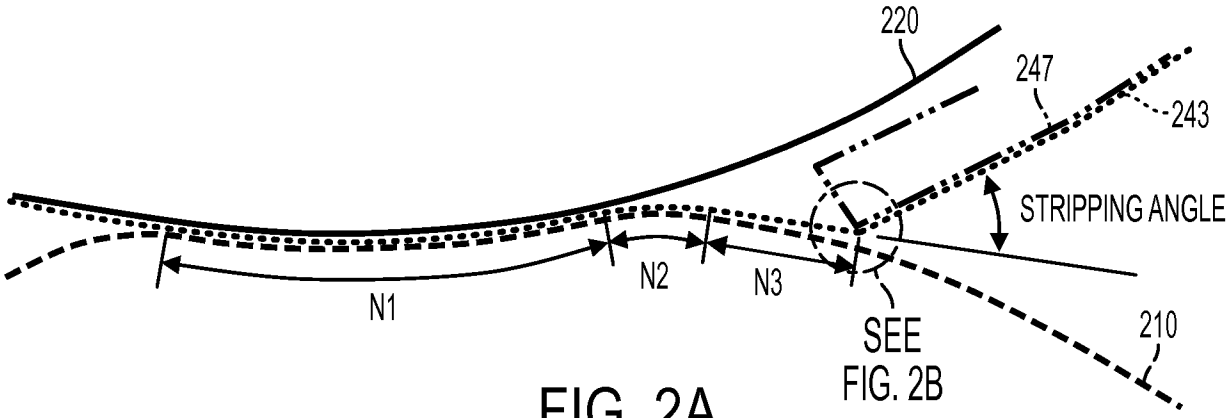
FIG. 2 shows a diagrammatical side view of a related art nip profile in a related art belt-roll fuser system.
Figure 2B:
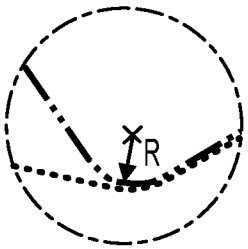

FIG. 2 shows a diagrammatical side view of a related art nip profile formed by a belt-roll fuser configuration of the type shown in FIG. 1. FIG. 2 shows a three zone nip (zones N1 (nip entrance), N2, and N3 (nip exit) formed by an external pressure roll 210 and an internal pressure roll, or fuser roll, 220. A fuser belt 243 is configured to wrap around a corner of a stripping shoe 247 at an exit of the nip, e.g., at zone N3 as shown in FIG. 2.

The zones of the related art nip profile include: N1, a high pressure nip zone (e.g., about 60 psi to about 80 psi); N2, a low pressure nip zone (e.g., about 6 psi to about 10 psi) where the fuser belt 243 changes direction, e.g., is guided in a direction away from the fuser roll 220; and N3, a nip zone (e.g., 0 psi) where there is substantially of the fuser belt 243 by the external pressure roll 210, and where the belt 243 from the external pressure roll 210 and is tangent with the stripping shoe 247 tip radius.

Image quality defects are typical at nip zones N2 and N3. For example, changes in a bend direction of a sheet as the sheet travels through the nip at zone N2, as shown in FIG. 2, may cause image defects. Also, as a lead edge of a sheet travels through nip zone N2, particularly if the sheet is a heavy weight sheet, the sheet may not conform to the external pressure member 210 at zone N2 where typically mere belt pressure exerts a force on the sheet toward the external pressure roll 210 at a pressure of about 6 to about 10 psi, for example. Due to the beam strength of the sheet, separation and subsequent reattachment of the sheet to the belt may occur in zone N2, resulting in the icicle IQ defect. Shortening the N2 nip zone to a particular length to avoid such defects with heavy paper may interfere with stripping functionality of light paper.

A sheet may stick to the belt 243 and/or to the external pressure roll 210 as the sheet travels through the N3 nip zone, depending on imaging density and image location. A sheet may separate and then re-touch the belt 243 causing image defects such as 'retack". Stripping does not occur with repeatability in related art systems, as shown in FIG. 2, until after a lead edge of the sheet reaches the strip shoe 247, past zone N3.

Figure 3:
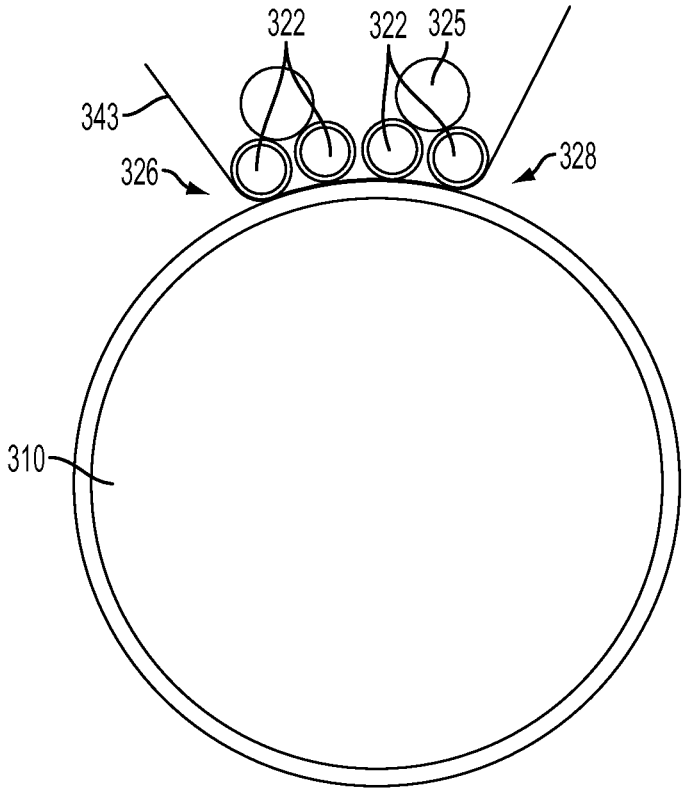
FIG. 3 shows a self-stripping belt-roll fuser system in accordance with an exemplary embodiment.

FIG. 3 shows a self-stripping belt roll fuser system in accordance with an embodiment. The self-stripping belt roll fuser system shown in FIG. 3 includes an external pressure member such as a roll 310. The system may include a belt roll apparatus that defines a fusing nip with the external pressure roll 310. A surface of the external pressure roll may comprise rubber, and/or may be a soft surface for compliance.

The belt roll fuser apparatus may include a plurality of internal pressure members such as internal pressure rolls 322. The plurality of internal pressure rolls 322 may entrain a fuser belt 343. The plurality of internal pressure rolls 322 may be hard rolls, and may formed of steel shafts surrounded by a urethane outer surface. The internal pressure rolls 322 may have small radii in relative to the external pressure roll 310 radius. The belt 343 may be formed of a polyimide carcass overcoated with a silicone layer and a viton top coat. The belt 343 and pressure rolls 322 may be configured to form a composite fusing nip when operably engaged with the external pressure roll 310, wherein each of the plurality of internal pressure rolls 322 contacts external pressure roll 310 to form the fusing nip.

The internal pressure rolls 322 may be supported by support rolls 325, for example, which may be used to tune the deflection of rolls 322. The internal pressure rolls 322 may be smaller than support rolls 325. The support rolls 325 may be configured to have various diameters for constraining the deflected shape of the internal pressure rolls 322 as required to produce a desired belt tension and/or nip pressure.

The internal pressure rolls 322 may be configured to apply a substantial and consistent nip pressure from a nip entrance 326 through the fusing nip to a nip exit at 328. For example, the plurality of internal rolls 322 may be arranged closely adjacent to one another, and in contact with the external pressure roll 310, the belt 343 interposing the internal pressure rolls 322 and the external pressure roll 310.

An entrance geometry of the nip profile as shown in FIG. 3 prevents excessive trail edge flip due to geometric factors such as roll diameter, roll location with respect to the paper path and a hard external pressure roll. A nip exit geometry enables self-stripping and/or easy air stripping, accommodated at least by the smaller diameter of internal pressure rolls 322, particularly a roll 322 at the nip exit. For example, an internal pressure roll diameter may be about 8 mm. An internal pressure roll diameter of 8 mm may produce a composite nip length of about 27 mm, which may enable a nip dwell time that is double that of related art fuser nips, or about twice the potential fusing speed. The fusing nip may be extended as necessary to achieved a desired dwell time by adding more internal pressure rolls 322.

Figure 4:
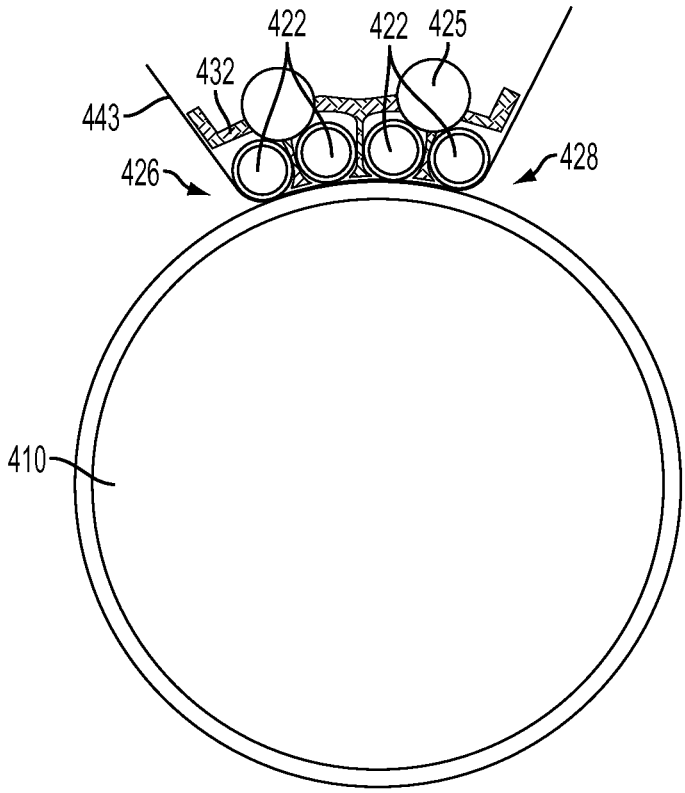
FIG. 4 shows a self-stripping belt-roll fuser system in accordance with an exemplary embodiment.

FIG. 4 shows a self-stripping belt roll fuser system in accordance with an embodiment. The self-stripping belt roll fuser system shown in FIG. 4 includes an external pressure member such as a roll 410. The system may include a belt roll apparatus that defines a fusing nip with the external pressure roll 410. A surface of the external pressure roll may comprise rubber for compliance, and/or may be a soft surface.

The belt roll fuser apparatus may include a plurality of internal pressure members such as internal pressure rolls 422. The plurality of internal pressure rolls 422 may entrain a fuser belt 443. The plurality of internal pressure rolls 422 may be hard rolls, and may formed of steel shafts surrounded by a urethane outer surface. The internal pressure rolls 422 may have small radii in relative to the external pressure roll 410 radius. The belt 443 may be formed of a polyimide carcass overcoated with a silicone layer and a viton top coat. The belt 443 and pressure rolls 422 may be configured to form a fusing nip when operably engaged with the external pressure roll 410, wherein each of the plurality of internal pressure rolls 422 contacts external pressure roll 410 to form the fusing nip. The internal pressure rolls 422 may be supported by one or more support members or rolls 425, for example, which may have diameters that are larger than that of internal pressure rolls 422, and/or varying diameters as necessary to produce a desired belt tension and/or to constrain the deflected shape of the internal pressure rolls 422 to produce a desired nip pressure.

The internal pressure rolls 422 may be configured to apply a substantially consistent nip pressure from a nip entrance 426 through the fusing nip to a nip exit at 428. For example, the plurality of internal rolls 422 may be arranged closely adjacent to one another, and in contact with the external pressure roll 410, the belt 443 interposing the internal pressure rolls 422 and the external pressure roll 410.

The arrangement of the plurality of internal pressure rolls 322 shown in FIG. 3 may accommodate a substantially constant pressure at the fusing nip. However, because there are portion(s) of the external pressure member 310 that oppose space(s) that interpose two internal pressure rolls 322 when the belt-roll apparatus is engaged with the external pressure roll 310. A nip pressure at these portions may be less than nip pressure at other portions of the fusing nip where the external pressure roll 310 contacts the internal pressure rolls 322, although the nip pressure profile is substantially constant across the length of the nip.

To further reduce a difference in nip pressures at various portions of the nip, particularly a difference between points at which the internal pressure roll contacts the external pressure roll and non-contact points, a passive fuser belt support 432 may be implemented in the belt roll apparatus, as shown in FIG. 4. The passive fuser belt support 432 may be formed by extrusion, for example, and may be configured to have elongate portions that interpose the internal pressure rolls 422. The interposing portions of the passive fuser belt 432 may be positioned close to, but not touching the un-deflected fuser belt 443. The interposing portions may be positioned so that when the belt 432 does deflect far enough, the belt 432 contacts the passive fuser belt support portion(s), receiving support therefrom, and being prevented from being deflected a desired extent. Accordingly, the passive belt support 432 may limit deflection of the belt, and movement of the belt in a direction away from the external pressure roll 410 that causes nonconformance.

Figure 5:
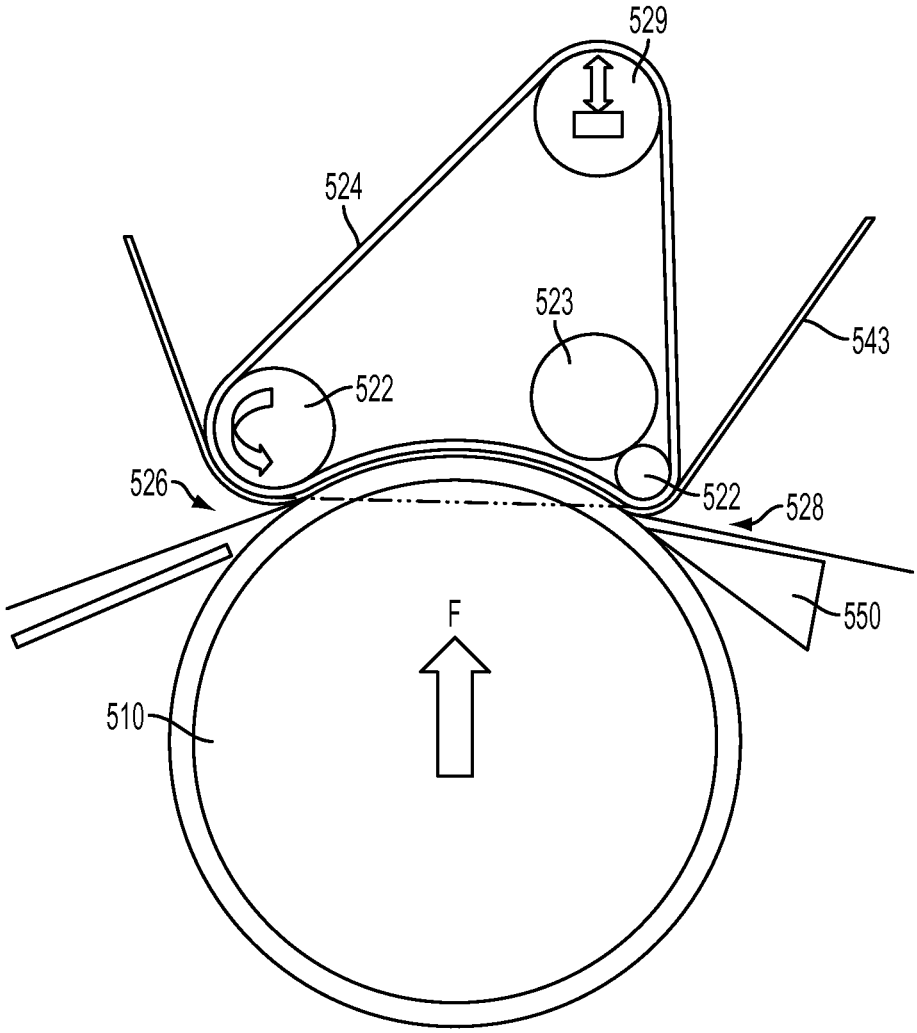
FIG. 5 shows a self-stripping belt-roll fuser system in accordance with an exemplary embodiment.

FIG. 5 shows a self-stripping belt roll fuser system in accordance with an embodiment having a hard pressure belt. The self-stripping belt roll fuser system shown in FIG. 5 includes an external pressure member such as a roll 510. The system may include a belt roll apparatus that defines a fusing nip with the external pressure roll 510. A surface of the external pressure roll may comprise rubber, such as thin silicone rubber and a viton topcoat, and/or may be a soft surface. The belt roll apparatus may be movable for centering the belt roll apparatus about the external pressure roll 510. The external pressure roll 510 may adjustable toward and away from an otherwise fixedly positioned belt roll apparatus for engagement and nip formation.

For example, at a beginning of a print job, the external pressure roll 510 may be configured to be driven toward the belt roll apparatus for engagement with the fuser belt 543, pressure belt 524, and internal pressure rolls 522. A pressure roll support 529 may be movable in a direction toward and away from the external pressure roll 510. The pressure support roll 529 may be spring loaded, and may be configured for moving to a hard stop where the pressure belt 524 and fuser belt 543 may conform to the curvature of the external pressure roll 510. The external pressure roll 510 would then move toward the belt roll apparatus for creating nip pressure and conformance to the pressure belt 524 and fuser belt 543 to meet the requirements of fusing an image to a sheet. The configuration shown in FIG. 5 may result in increased dwell time with reduced nip pressure requirements, for example.

The belt roll fuser apparatus may include a plurality of internal pressure members such as internal pressure rolls 522. The plurality of internal pressure rolls 522 may entrain a fuser belt 543. The fuser belt 543 may be heated by one or more rolls that entrain the belt. The plurality of internal pressure rolls 522 may be hard rolls, and may formed of steel shafts surrounded by a urethane outer surface. The internal pressure rolls 522 may have small radii in relative to the external pressure roll 510 radius. The belt 543 may be formed of a polyimide carcass overcoated with a silicone layer and a viton top coat. The belt 543 and pressure rolls 522 may be configured to form a fusing nip when operably engaged with the external pressure roll 510, wherein each of the plurality of internal pressure rolls 522 contacts external pressure roll 510 to form the fusing nip. The internal pressure rolls 522 may be supported by support roll(s) 523, for example. The support roll(s) 523 may have a diameter that is larger than an internal pressure roll 522.

A hard pressure belt 524 may be entrained by the plurality of internal pressure rolls 522, and at least one pressure belt support 529. The pressure belt 524 may be formed of metal, for example steel or nickel alloy. The fuser belt 543 may be soft, and formed of a polyimide carcass overcoated with a silicone layer and a viton top coat. The pressure roll support 529 may be adjustable for changing a tension of the pressure belt 524. The pressure belt 524 may be heated by one or more rolls that entrain the pressure belt 524. The pressure belt 524 may interpose the fuser belt 543 and the internal pressure rolls 522. A first internal pressure roll 522 may define the nip entrance 526 and a second internal pressure roll 522 may define the nip exit 528. The belt roll apparatus may be configured so that the belt 543 contacts the external pressure roll 510 across an entire length of the fusing nip defined by the internal pressure rolls 522, belt 543, pressure belt 524, and external pressure roll 510.

The internal pressure rolls 522 may be configured to apply a substantial and consistent nip pressure from a nip entrance 526 through the fusing nip to a nip exit at 528. For example, the plurality of internal rolls 522 may be arranged closely adjacent to one another, and in contact with the external pressure roll 510, the belt 543 interposing the internal pressure rolls 522 and the external pressure roll 510. The external pressure roll 510 may be adjustable toward the internal pressure rolls 522 for adjusting a tension in the belt(s).

The second internal pressure roll 522 that forms the nip exit 528 may have a smaller radius than the first pressure roll 522 that forms the nip entrance 526. Accordingly, a distance between the belt 543 and the external pressure roll 510 at the nip exit may be minimized, thereby allowing enhanced control over exiting of a sheet from the fusing nip exit 528. A stripping finger 550 may be positioned adjacent to the external pressure roll 510 for stripping sheets from a surface of the external pressure roll 510.

Figure 6:
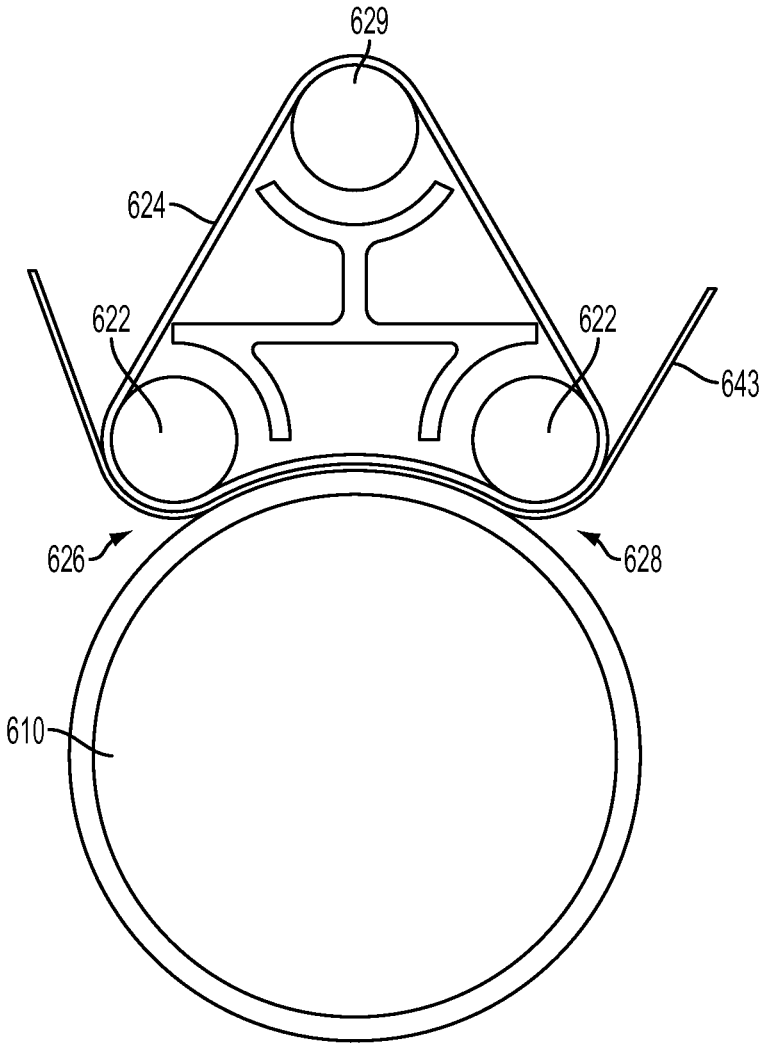
FIG. 6 shows a self-stripping belt-roll fuser system in accordance with an exemplary embodiment.

In an alternative embodiment, as shown in FIG. 6, a belt roll system may include an external pressure roll 610, and a belt roll apparatus having a plurality of internal pressure rolls 622 that are configured for forming a nip when operably engaged to the external pressure roll 610.

A first internal pressure roll 622 may be configured to define a nip entrance 626 with the external pressure roll 610. A second internal pressure roll 622 may be configured to define a nip exit 628 with the external pressure roll 610. The first internal pressure roll 622 and the second internal pressure roll 622 may be of substantially equal radii.

The internal pressure rolls 622 may entrain a fuser belt 643. The fuser belt 643 may interpose the external pressure roll 610 and the internal pressure rolls 622 at the fusing nip, and may be in substantially continuous contact with the external pressure roll 610 through the entire length of the nip.

The internal pressure rolls 622 and a pressure belt support 629 may be configured to entrain a pressure belt 624. The belt roll fuser apparatus may include a pressure belt 624 that interposes the fuser belt 643 and the internal pressure rolls 622 at the fusing nip defined by the internal pressure rolls 622 and the external pressure roll 610.

While methods, apparatus, and systems for self-stripping and continuous belt contact during fusing are described in relationship to exemplary embodiments, many alternatives, modifications, and variations would be apparent to those skilled in the art. Accordingly, embodiments of the methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A belt-roll fuser apparatus, comprising:

a first internal pressure roll;

a second internal pressure roll;

a fuser belt, the fuser belt being supported by at least the first internal pressure roll and the second internal pressure roll, the first internal pressure roll and the second internal pressure roll being configured to engage an external pressure roll to define a fusing nip, wherein the first internal pressure roll and the second internal pressure roll have radii that are each less than a radius of the external pressure roll;

a third internal pressure roll, the third internal pressure roll being configured to engage the external pressure roll to define the fusing nip, the third internal pressure roll interposing the first internal pressure roll and the second internal pressure roll; and a passive belt support, the belt support being configured to interpose each of the first, second, and third internal pressure roll for preventing deflection of the belt away from the external pressure roll at the fusing nip when the first internal pressure roll and the second internal pressure roll are engaged.

2. The apparatus of claim 1, wherein the first internal pressure roll is configured to define a nip entrance, and the second internal pressure roll is configured to define a nip exit.

3. The apparatus of claim 1, wherein the first internal pressure roll and the second internal pressure roll have radii that are each smaller than a radius of the external pressure roll.

4. The apparatus of claim 1, wherein the second internal pressure roll has a radius that is smaller than a radius of the first internal pressure roll.

5. The apparatus of claim 1, wherein when the belt roll apparatus is engaged with the external pressure roll to define the fusing nip, the first internal pressure roll forcing the fuser belt against the external pressure roll at a nip entrance, and the second internal pressure forcing the fuser belt against the external pressure roll at the nip exit.

6. The apparatus of claim 5, comprising the fuser belt being conformed to the external pressure roll from the nip entrance to the nip exit, the belt being conformed to the external pressure by at least the first internal pressure roll and the second internal pressure roll.

7. The apparatus of claim 1, comprising:

a pressure belt, the pressure belt being entrained by a pressure belt support roll, the first internal pressure roll, and the second internal pressure roll, the pressure belt interposing the fuser belt and the pressure belt support roll, first internal pressure roll, and second internal pressure roll.

8. The apparatus claim 7, the pressure belt further comprising:

a surface comprising metal.

9. The apparatus of claim 1, wherein the fuser belt is heated for fusing a sheet at the fusing nip.

10. The apparatus of claim 1, wherein the external pressure is heated for fusing a sheet at the fusing nip.

11. A self-stripping belt roll fuser system for a printing system, comprising:

an external pressure roll;

a first internal pressure roll;

a second internal pressure roll;

a fuser belt, the fuser belt being supported by at least the first internal pressure roll and the second internal pressure roll, the first internal pressure roll and the second internal pressure roll being configured to engage the external pressure roll to define a fusing nip, the first internal pressure roll defining a nip entrance and the second internal pressure roll defining a nip exit; and a pressure belt, the pressure belt being entrained by at least the first internal pressure roll and the second internal pressure roll, the pressure belt interposing the fuser belt and the first internal pressure roll and the second internal pressure roll.

12. The system of claim 11, wherein a surface of pressure belt comprises metal, the surface contacting the fuser belt.

13. The system of claim 11, wherein the first internal pressure roll and the second internal pressure roll each have a radius that is less than a radius of the external pressure roll.

14. The system of claim 11, wherein a radius of the first internal pressure roll is greater than a radius of the second internal pressure roll.

15. The system of claim 12, the fuser belt comprising a surface that is softer than the pressure belt.

* * * * *